US012758838B2

(12) United States Patent
Fischbeck et al.

(10) Patent No.: US 12,758,838 B2
(45) Date of Patent: Oct. 13, 2026

(54) PORTABLE OUTDOOR GAME WITH VERSATILE, COLLAPSIBLE STORAGE

(71) Applicants: Jeffrey E. Fischbeck, Coto de Caza, CA (US); Jonathan Gibney, Foothill Ranch, CA (US); Ryan Buckles, Laguna Niguel, CA (US)

(72) Inventors: Jeffrey E. Fischbeck, Coto de Caza, CA (US); Jonathan Gibney, Foothill Ranch, CA (US); Ryan Buckles, Laguna Niguel, CA (US)

( * ) Notice: Subject to any disclaimer, the term of this patent is extended or adjusted under 35 U.S.C. 154(b) by 325 days.

(21) Appl. No.: 18/610,014

(22) Filed: Mar. 19, 2024

(65) Prior Publication Data

US 2024/0374974 A1 Nov. 14, 2024

Related U.S. Application Data

(63) Continuation of application No. 18/206,540, filed on Jun. 6, 2023, now abandoned, which is a continuation of application No. 17/992,687, filed on Nov. 22, 2022, now abandoned, which is a continuation of application No. 17/348,733, filed on Jun. 15, 2021, now abandoned.

(60) Provisional application No. 63/039,412, filed on Jun. 15, 2020.

(51) Int. Cl.
*A63B 67/06* (2006.01)
*A63B 63/08* (2006.01)

(52) U.S. Cl.
CPC ..... *A63B 67/06* (2013.01); *A63B 63/08* (2013.01); *A63B 2210/50* (2013.01)

(58) Field of Classification Search
CPC ..... A63B 63/08; A63B 67/06; A63B 2210/50
See application file for complete search history.

(56) References Cited

U.S. PATENT DOCUMENTS

| | | | | |
|---|---|---|---|---|
| 5,351,968 | A | 10/1994 | Starnes | |
| 6,997,111 | B2 * | 2/2006 | Giegerich | A47B 3/002 108/115 |
| 7,765,941 | B2 * | 8/2010 | Chen | A47B 3/083 108/174 |
| 7,784,795 | B1 * | 8/2010 | Liao | A63B 67/06 273/400 |
| 8,915,195 | B2 | 12/2014 | Berkowitz | |
| 9,950,230 | B2 * | 4/2018 | Silva | A47C 7/624 |
| 2016/0166068 | A1 * | 6/2016 | Holzhauzer | A63B 67/06 297/16.1 |
| 2016/0192783 | A1 * | 7/2016 | Kelly | E04H 15/50 135/96 |
| 2021/0236897 | A1 * | 8/2021 | Eanniello | A63B 63/08 |
| 2021/0354015 | A1 * | 11/2021 | McMurtry | A63B 67/06 |
| 2021/0387065 | A1 * | 12/2021 | Fischbeck | A63B 67/06 |
| 2025/0032874 | A1 * | 1/2025 | Morris | A63B 63/08 |

* cited by examiner

*Primary Examiner* — Audrey B. Walter
(74) *Attorney, Agent, or Firm* — ONE LLP

(57) ABSTRACT

An outdoor portable game. The invention includes a donut shaped game board defining a center with a single opening and a basket underneath the opening for capturing bean bags being tossed into the opening during game play. The donut shaped game board is supported by a collapsible base, thereby enabling portability and easy-of-setup.

6 Claims, 6 Drawing Sheets

PORTABLE OUTDOOR GAME WITH VERSATILE, COLLAPSIBLE STORAGE

CROSS-REFERENCE TO RELATED APPLICATIONS

The present application is a continuation of U.S. patent application Ser. No. 18/206,540, filed Jun. 6, 2023, which is a continuation of U.S. patent application Ser. No. 17/992,687, filed Nov. 22, 2022, now abandoned, which is a continuation of U.S. patent application Ser. No. 17/348,733, filed Jun. 15, 2021, now abandoned, which claims priority to U.S. Provisional Application Ser. No. 63/039,412, filed Jun. 15, 2020, all of which are hereby incorporated by reference in their entireties for all purposes.

FIELD OF INVENTION

The subject matter described herein relates to outdoor game design and more particularly to a portable game with versatile, collapsible storage.

BACKGROUND

There are a number of popular outdoor games, those suited for parks and beaches in particular. One notable game is Cornhole, which involves tossing a bean bag from a certain distance on a raised platform with a hole at the end. Scores are counted based on whether a bag is thrown into the hole or how far it landed from the hole if not.

Another popular game is Roundnet, also popularly referred to as Spikeball, which involves a raised cloth service and net, which players attempt to bounce a small rubber ball onto.

Disclosed herein is a novel game design as an alternative to the previously described outdoor games.

SUMMARY

The subject matter described herein relates to outdoor game design and more particularly to a portable game with versatile, collapsible storage. In one embodiment, the portable game includes a game board defining a center; a net coupled to the center of the game board; and a structure to support the game board at a certain height above the ground.

Other systems, devices, methods, features and advantages of the subject matter described herein will be or will become apparent to one with skill in the art upon examination of the following figures and detailed description. It is intended that all such additional systems, devices, methods, features, and advantages be included within this description, be within the scope of the subject matter described herein and be protected by the accompanying claims. In no way should the features of the example embodiments be construed as limiting the appended claims, absent express recitation of those features in the claims.

BRIEF DESCRIPTION OF THE DRAWINGS

The details of the subject matter set forth herein, both as to its structure and operation, may be apparent by study of the accompanying figures, in which like reference numerals refer to like parts. The components in the figures are not necessarily to scale, emphasis instead being placed upon illustrating the principles of the subject matter. Moreover, all illustrations are intended to convey concepts, where relative sizes, shapes and other detailed attributes may be illustrated schematically rather than literally or precisely.

DETAILED DESCRIPTION

Described herein are example outdoor game designs. Before the present subject matter is described in detail, it is to be understood that this disclosure is not limited to the particular embodiments described, as such may, of course, vary. It is also to be understood that the terminology used herein is for the purpose of describing particular embodiments only, and is not intended to be limiting, since the scope of the present disclosure will be limited only by the appended claims.

As used herein and in the appended claims, the singular forms "a," "an," and "the" include plural referents unless the context clearly dictates otherwise.

Figure 1:
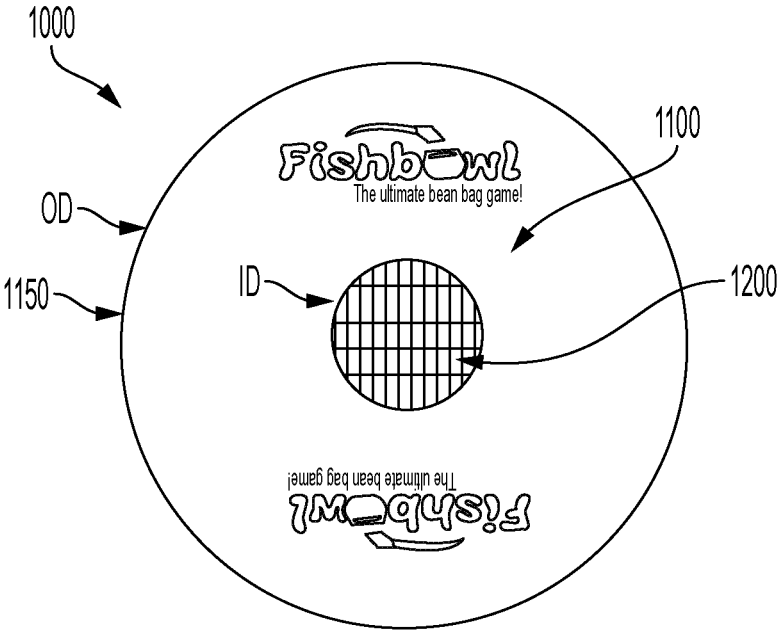
FIG. 1 is a top view of a game in accordance with a preferred embodiment of the present invention.
Figure 3:
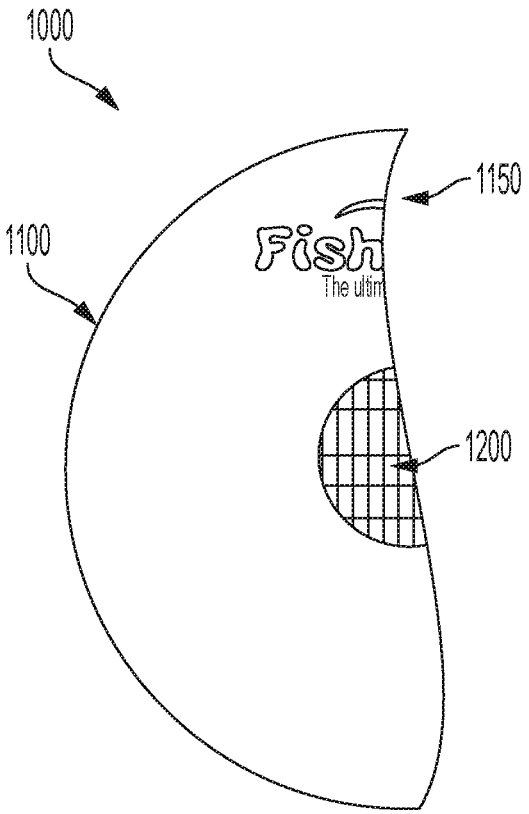
FIG. 3 is a view of a game board folded in half in accordance with a preferred embodiment of the present invention.

Turning to FIG. 1, an exemplary embodiment of the outdoor portable game 1000 of the present invention is shown with a top view. Game 1000 includes a donut shaped game board 1100. The donut shaped game board 1100 comprises a flexible cloth that provides a bouncy or springy surface, attached to a hinged, foldable rigid circular frame 1150 that can be folded in half as shown in FIG. 3. The rigid frame 1150 of game board 1100 maintains shape during game play as will be described in more detail below. The outer diameter OD of the game board 1100 is approximately 36" in diameter. The inner diameter ID is approximately 8" in diameter and houses a cylindrical basket 1200 made of a netting material attached to the inner diameter ID of game board 1100.

Figure 2:
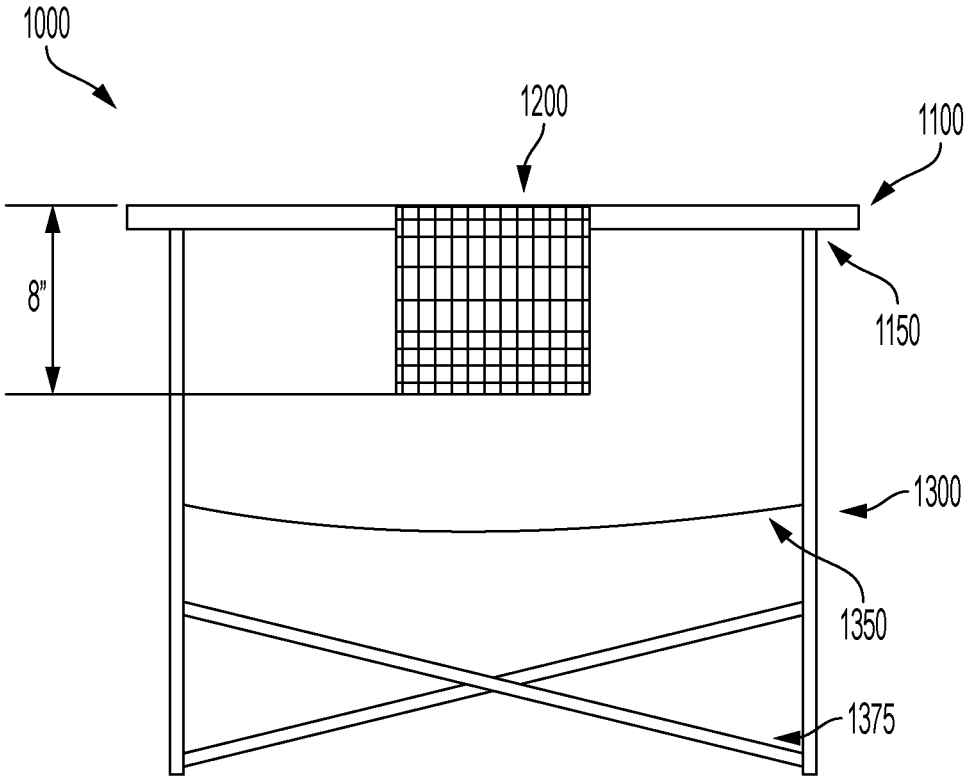
FIG. 2 is a side view of a game in accordance with a preferred embodiment of the present invention.

Turning to FIG. 2, a side view of game 1000 is shown. The side view of game 1000 shows a side view of basket 1200 attached to the inner diameter ID of game board 1100. The basket is generally about 8" in height. Game board 1100 sits on top of and is attached to a collapsible base 1300 via a set of detachable clips (not explicitly shown) at 1150. The collapsible base 1300 further includes a lower platform 1350, which can add versatility and storage during play. The collapsible base 1300 further includes foldable legs, 1375, enabling the collapsible feature.

Figure 4:
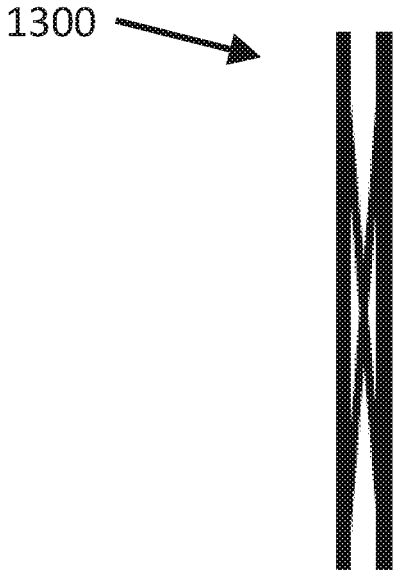
FIG. 4 is a view of a support structure for the game board collapsed in accordance with a preferred embodiment of the present invention.

Turning to FIG. 3, game board 1100 is shown detached from base 1300 and folded in half for transport and storage. Turning to FIG. 4, base 1300 is shown detached from game board 1100 and collapsed into minimal size.

Figure 5:
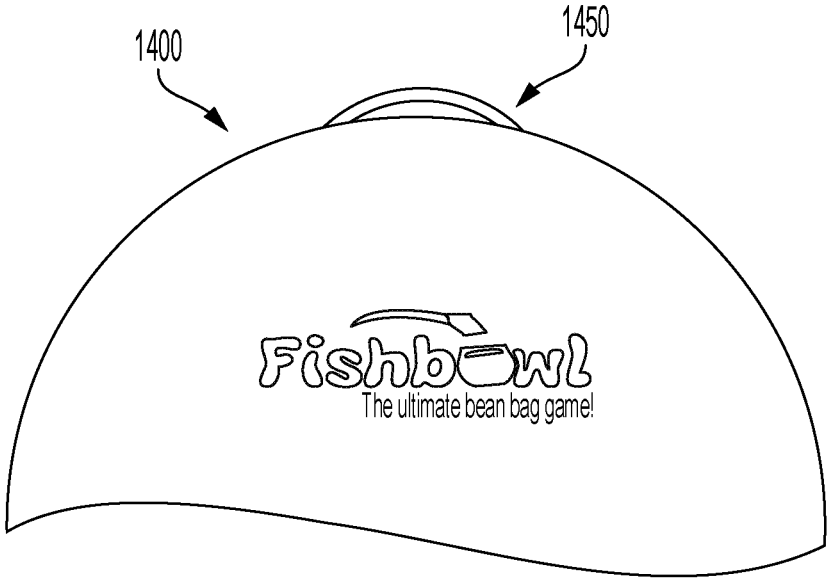
FIG. 5 is a storage bag for the game in accordance with a preferred embodiment of the present invention.

Turning to FIG. 5, a carrying and storage bag 1400 is shown, with handle 1450. Bag 1400 is generally made of canvas material and is designed to carry board 1100 folded in half as shown in FIG. 3, and collapsed base 1300 as shown in FIG. 4.

Figure 6:
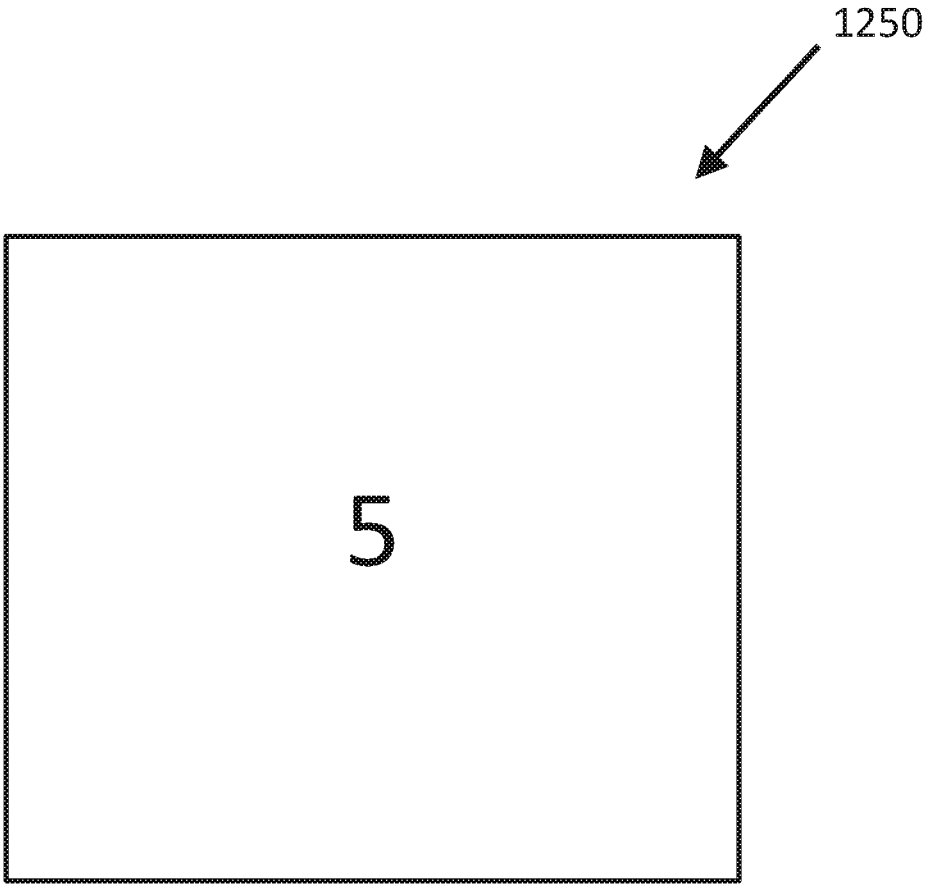
FIG. 6 is a figure of a bean bag in accordance with a preferred embodiment of the present invention.

Turning to FIG. 6, an exemplary bean bag 1250 is shown. It can be numbered for various games, e.g., 5, and is generally square shaped and can be similar to a Cornhole bean bag. During play, players will toss a bean bag 1250 towards game board 1100 as will be described below.

Figure 7:
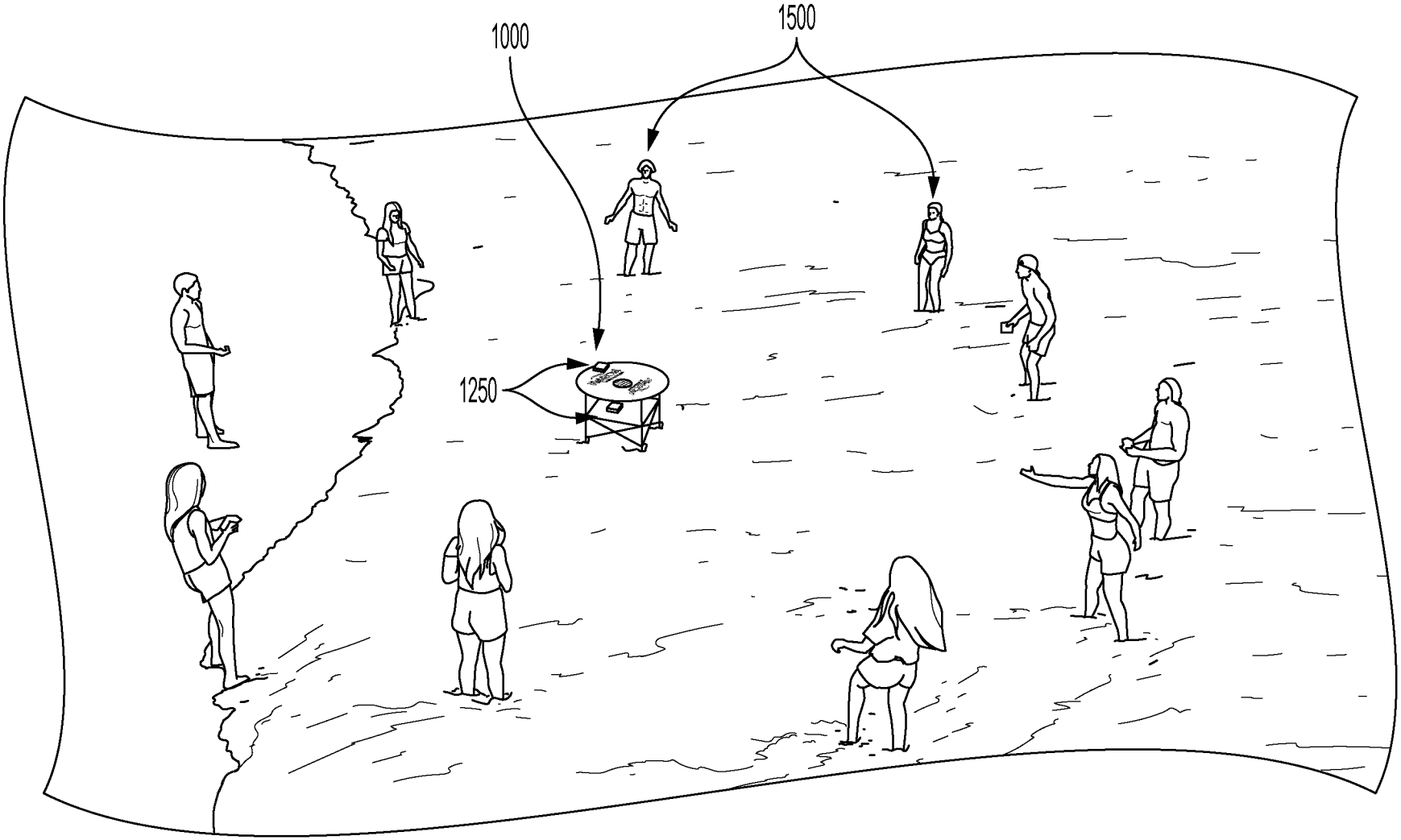
FIG. 7 is a perspective view of a game in accordance with a preferred embodiment of the present invention during game play.

Turning to FIG. 7, game 1000 is shown with a perspective view assembled and being used by a plurality of players 1500 surrounding game 1000 at a beach at a certain distance. Game 1000 further includes a plurality of bean bags 1250. Bean bags 1250 are included in sets of 3-4 bean bags 1250, each set being a different color to discern which player each bean bag 1250 belongs to.

Below are rules for an example game to be played with game 1000.

1. All players grab 1-3 bags 1250 and stand at an equal distance around game 1000.
2. Take turns throwing a bag 1250 at gameboard 1100.
3. Once all bags 1250 have been thrown, everyone claims their bags 1250 and tallies own score.
4. If a bag 1250 lands in the center net 1200, it is worth 3 points
5. If a bag 1250 lands on the game board 1100 donut portion between the inner diameter ID and outer diameter OD, it is worth 1 point.
6. If the board 1100 is missed, no points are awarded.

Throughout this disclosure, the preferred embodiment and examples illustrated should be considered as exemplars, rather than as limitations on the present inventive subject matter, which includes many inventions. As used herein, the term "inventive subject matter," "system," "device," "apparatus," "method," "present system," "present device," "present apparatus" or "present method" refers to any and all of the embodiments described herein, and any equivalents.

It should also be noted that all features, elements, components, functions, and steps described with respect to any embodiment provided herein are intended to be freely combinable and substitutable with those from any other embodiment. If a certain feature, element, component, function, or step is described with respect to only one embodiment, then it should be understood that that feature, element, component, function, or step can be used with every other embodiment described herein unless explicitly stated otherwise. This paragraph therefore serves as antecedent basis and written support for the introduction of claims, at any time, that combine features, elements, components, functions, and steps from different embodiments, or that substitute features, elements, components, functions, and steps from one embodiment with those of another, even if the following description does not explicitly state, in a particular instance, that such combinations or substitutions are possible. It is explicitly acknowledged that express recitation of every possible combination and substitution is overly burdensome, especially given that the permissibility of each and every such combination and substitution will be readily recognized by those of ordinary skill in the art.

When an element or feature is referred to as being "on" or "adjacent" to another element or feature, it can be directly on or adjacent the other element or feature or intervening elements or features may also be present. In contrast, when an element is referred to as being "directly on" or extending "directly onto" another element, there are no intervening elements present. Additionally, when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Furthermore, relative terms such as "inner," "outer," "upper," "top," "above," "lower," "bottom," "beneath," "below," and similar terms, may be used herein to describe a relationship of one element to another. Terms such as "higher," "lower," "wider," "narrower," and similar terms, may be used herein to describe angular relationships. It is understood that these terms are intended to encompass different orientations of the elements or system in addition to the orientation depicted in the figures.

Although the terms first, second, third, etc., may be used herein to describe various elements, components, regions, and/or sections, these elements, components, regions, and/or sections should not be limited by these terms. These terms are only used to distinguish one element, component, region, or section from another. Thus, unless expressly stated otherwise, a first element, component, region, or section discussed below could be termed a second element, component, region, or section without departing from the teachings of the inventive subject matter. As used herein, the term "and/or" includes any and all combinations of one or more of the associated list items.

The terminology used herein is for the purpose of describing particular embodiments only and is not intended to be limiting. As used herein, the singular forms "a," "an," and "the" are intended to include the plural forms as well, unless the context clearly indicates otherwise. For example, when the present specification refers to "an" assembly, it is understood that this language encompasses a single assembly or a plurality or array of assemblies. It will be further understood that the terms "comprises," "comprising," "includes," and/or "including" when used herein, specify the presence of stated features, integers, steps, operations, elements, and/or components, but do not preclude the presence or addition of one or more other features, integers, steps, operations, elements, components, and/or groups thereof.

Embodiments are described herein with reference to view illustrations that are schematic illustrations. As such, the actual thickness of elements can be different, and variations from the shapes of the illustrations as a result, for example, of manufacturing techniques and/or tolerances are expected. Thus, the elements illustrated in the figures are schematic in nature and their shapes are not intended to illustrate the precise shape of a region and are not intended to limit the scope of the inventive subject matter.

The foregoing is intended to cover all modifications, equivalents and alternative constructions falling within the spirit and scope of the invention as expressed in the appended claims, wherein no portion of the disclosure is intended, expressly or implicitly, to be dedicated to the public domain if not set forth in the claims. Furthermore, any features, functions, steps, or elements of the embodiments may be recited in or added to the claims, as well as negative limitations that define the inventive scope of the claims by features, functions, steps, or elements that are not within that scope.

What is claimed is:

1. An outdoor portable game comprising:

a donut shaped game board defining a center with a single opening, wherein the donut shaped game board is configured to be substantially level during play;

a net coupled to the single opening at the center of the donut shaped game board defining a basket, having a bottom, underneath the donut shaped game board; and a structure to support the donut shaped game board a certain height above the ground said structure including:

a collapsible base from which the donut shaped game board sits on top of, wherein the collapsible base includes:

a lower platform positioned below the level donut shaped game board and the bottom of the basket for storage during play, and foldable legs positioned below the lower platform to support the donut shaped game board at the certain height above ground during play.

2. The outdoor portable game of claim 1, wherein the donut shaped game board is configured to be capable of being folded in half.

3. The outdoor portable game of claim 1, wherein the donut shaped game board comprises a flexible material.

4. The outdoor portable game of claim 1, further comprising a plurality of bean bags configured to fit within the net.

5. The outdoor portable game of claim 1, wherein the donut shaped game board comprises a flexible cloth, wherein the flexible cloth provides a bouncy surface.

6. The outdoor portable game of claim 1, wherein the game board is substantially circular in shape.

* * * * *